United States Patent [19]

Bortoluzzi

[11] Patent Number: 4,949,504

[45] Date of Patent: Aug. 21, 1990

[54] GUIDING DEVICE FOR SLIDING DOORS WHICH ARE RECIPROCALLY COPLANAR AT THE CLOSED POSITION THEREOF

[75] Inventor: Guido Bortoluzzi, Belluno, Italy

[73] Assignee: Molteni & C. S.p.A., Milan, Italy

[21] Appl. No.: 346,935

[22] Filed: May 3, 1989

[30] Foreign Application Priority Data

May 3, 1988 [IT] Italy ..... 45721 A/88

[51] Int. Cl.[5] ..... E05D 15/20

[52] U.S. Cl. ..... 49/130; 49/213; 49/219

[58] Field of Search ..... 49/216, 218, 130, 128, 49/127, 219, 213, 129

[56] References Cited

U.S. PATENT DOCUMENTS

| | | | |
|---|---|---|---|
| 834,673 | 10/1906 | Hussey et al. | 49/130 |
| 1,636,806 | 7/1927 | Campbell | 49/128 |
| 4,752,106 | 6/1988 | Salvarani | 49/130 |

FOREIGN PATENT DOCUMENTS

| | | |
|---|---|---|
| 0195880 | 10/1986 | European Pat. Off. . |
| 1149950 | 1/1958 | France . |
| 182913 | 3/1936 | Switzerland . |

*Primary Examiner*—Kenneth J. Dorner

*Assistant Examiner*—Gerald A. Anderson

*Attorney, Agent, or Firm*—Wenderoth, Lind & Ponack

[57] ABSTRACT

The present invention is drawn to guide structure in a piece of furniture having a group of sliding doors including first and second doors alternately disposed in a coplanar relation when in respective closed positions thereof. Each first door is slidably guided in a lateral direction by 2 first group of guide members via rigid connecting elements connected thereto and sliding elements in sliding engagement with the first group of guide members. Each of the second doors is not only slidably guided in the lateral direction by a second group of guide members but is forwardly shiftable in the piece of furniture via articulating parallelogram linkages connected thereto and sliding elements in sliding engagement with the second group of guide members. A third group of longitudinal guide members are disposed adjacent and extend parallel to the first and second groups of guide members. The third group of longitudinal guide members has an arcuate portion which, when engaged by the sliding unit, positions a respective second door at the closed position thereof. When the sliding unit is moved off of the arcuate portion, the second door is shifted forwardly under the articulation of the parallelogram linkage connected thereto.

16 Claims, 3 Drawing Sheets

GUIDING DEVICE FOR SLIDING DOORS WHICH ARE RECIPROCALLY COPLANAR AT THE CLOSED POSITION THEREOF

BACKGROUND OF THE INVENTION

The present invention relates to structure which can be utilized with sliding doors or the like, particularly sliding doors of a piece of furniture, which device is able to permit the doors to be coplanar at closed positions thereof.

Different devices and systems are known which permit doors, windows or other similar elements, which are slid to be opened or closed, to assume a coplanar alignment at the closed positions thereof.

Usually, the most simple known devices and systems can be fitted only to a pair of sliding elements, so that when more than two sliding elements are employed in a piece of furniture, the piece must have groups of pairs of sliding elements in which each group can translate laterally in one predetermined direction.

Various devices have been designed and constructed for the same purpose, such as those described in Italian patent applications n. 41614 A/81, n. 41606 A/82, and n. 41601 A/83 filed in Italy, respectively, on Sep. 17, 1981, June 24, 1982 and Sep. 6, 1983 by the firm KAIROS S.n.C. These devices are rather complicated and thus the assembly thereof is also complicated and difficult.

Finally, these devices present considerable functional drawbacks in that the sliding operation of the doors is quite difficult and requires accurate adjustment operations.

Besides, large forces are required, particularly for starting the sliding operation. And, some of the doors tend to arrive at the end positions under rapid movements, which cause considerable impact in the furniture to such a degree that in some cases dampener devices which are also rather complicated and expensive were needed.

In addition, in order to permit reciprocal movement of the doors during the starting and final movements thereof, the vertical and lateral edges of the same doors require wide bevels which define very large angles and thereby limit the design parameters of the piece of furniture.

Finally, the door actuation for opening and closing the doors is normally accomplished by a side translation thereof in a single direction.

A further considerable drawback of the conventional sliding doors is that the door is bent with respect to the vertical when the door is hung on guide members disposed on the upper side of the piece of furniture and is rested on guide members disposed on the lower side thereof.

Such a drawback is caused by the fact that the brackets connecting the doors to the guide members are rigidly connected to the upper or lower ends of the same doors, thus forming projecting elements which transform the load due to the weight of the doors into a moment. When the doors are hung on the upper side thereof the moment tends to deform them while bending them inwardly. And, on the contrary, when the doors are resting on the lower side thereof, the moment tends to deform them while bending them outwardly.

Different devices are known to obviate this drawback by at least partly correcting for the bending. However, these devices are more or less complicated, involve a supplementary cost and above all always require accurate adjustment operations, which operations must be repeated often.

SUMMARY OF THE INVENTION

An object of the present invention is to obviate all of the above-mentioned drawbacks.

This object is achieved by the device according to the present invention which is characterized in that it comprises two groups of sliding doors, disposed alternately with respect to each other and respectively supported at their upper and lower ends by a first and a second group of parallel and longitudinal rectilinear guide members. These guide members are disposed in the front of the lower and upper parts of the piece of furniture. A first group of sliding doors is connected to a respective first group of guide members by rigid elements, thus being able to translate only laterally therealong. And, a second group of sliding doors is connected to a respective second group of guide members by an articulated parallelogram linkage, thus being able to not only translate laterally but also to shift towards the front of the piece of furniture so as to be positioned in such a manner as to allow reciprocal lateral displacements of two doors adjacent thereto. Two longitudinal guide elements are connected to the lower and upper ends of a first group of sliding doors, which elements terminate at inclined portions, in which respective sliding elements connected to the lower and upper ends of a second group of adjacent doors are engaged. The doors of said second group are also rigidly connected by a sliding unit to a third group of longitudinal guide members which are arranged adjacent and parallel to the other guide members. The third group of longitudinal guide members are provided, in correspondence with each second door, with an accurate portion projecting inwardly, at the inner end of which said sliding unit is positioned when the door connected thereto is disposed in a coplanar relation with the other doors at the closed positions thereof. The accurate portion guides the shifting of the door until the sliding unit is guided by the rectilinear portion, which shifting may be obtained either by pulling the door outwardly or by laterally translating one of the doors adjacent thereto in such a manner that said sliding elements cause such shifting when said sliding elements engage the inclined portions of adjacent longitudinal guide elements. The doors of said first group may also comprise bellows elements supported with adequate trucks on appropriate ones of guide members.

BRIEF DESCRIPTION OF THE DRAWINGS

Other features and advantages of the invention will become apparent from the description of a non-limitative example thereof made with reference to the attached drawings in which:

FIGS. 6 and 7 are sectional views of the same embodiment taken, respectively, along line 6—6 of FIG. 4 and line 7—7 of FIG. 5.

Throughout such figures, corresponding elements are marked with the same numerical references.

Figures 1, 2, 3:
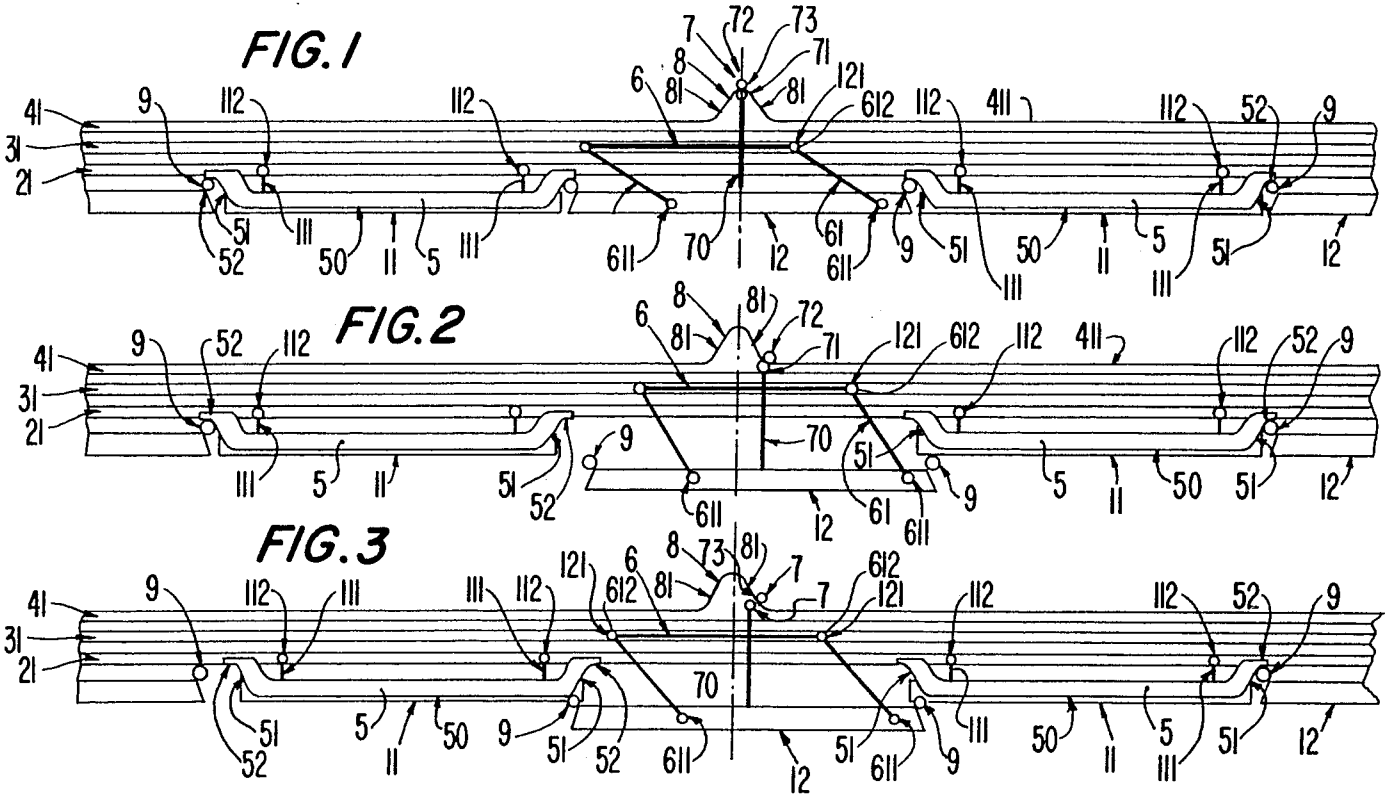
FIGS. 1, 2 and 3 are schemata of the device according to the present invention and illustrate the operation thereof.

Moreover, in FIGS. 1, 2 and 3 the sliding doors are illustrated by a generic transversal section thereof and a sole group of guide members is indicated schematically. The guide members are provided with respective kinematic motion devices to connect and control the doors.

Obviously, the sections illustrated in the schemata will be in practice provided on the lower and upper side of the piece of furniture (or the like). The elements in the figures marked with a numerical reference in the detailed embodiment thereof are also marked, if provided at the lower or upper side of the piece of furniture, with literal reference "i" or "s", respectively. It is also pointed out that in such schemata the sliding guide members of the doors are illustrated at the location which is to be considered inside the piece of furniture.

DETAILED DESCRIPTION OF THE PREFERRED EMBODIMENTS

Referring to FIGS. 1, 2 and 3, a first group of doors 11 is connected to a first rectilinear longitudinal guide member 21 through respective pairs of rigid elements 111, extending from the rear side of the doors 11 (inner side of the piece of furniture) and slidably engaging said first rectilinear longitudinal guide member 21 via suitable sliding elements 112. A second group of doors 12 is connected to a second rectilinear longitudinal guide member 31, disposed parallel to guide member 21, by means of respective articulate parallelogram linkages 6 (which are described hereinafter in more detail) extending from the rear side of the doors 12 and slidably engaging said second rectilinear longitudinal guide member 31 via suitable sliding elements 121. The doors 12 are also connected to a third longitudinal guide member 41 by respective rigid arms 70, extending from the rear central side of said doors 12 and slidably engaging said third longitudinal guide member 41 via a suitable sliding unit 7.

Said third longitudinal guide member 41 substantially comprises a longitudinal element disposed parallel to the other guide members 21, 31 and provided with, in correspondence with the vertical axis of the doors 12, an accurate portion 8 projecting at the rear thereof to such a degree as to form a projection rather larger than the thickness of the doors 11, 12.

More specifically, the arcuate portion 8 comprises two short rectilinear side portions 81 symmetrically converging in a direction away from the doors, which portions are joined together at their vertex with adequate radiate parts.

More particularly, as is clear from the figures, each said articulate parallelogram linkage 6 comprises two arms 61 identical to each other and forming two parallel sides, and which arms are pivotally connected at their ends with pivots 611 to the respective door 12 at one side thereof and with the pivots 612 to a longitudinal bar 62 at the other side thereof. The door 12 and bar 62 thus form the other two equal and parallel sides of the articulated parallelogram linkage 6.

Said pivots 612 situated at the ends of said longitudinal bar 62 are mounted to the respective sliding elements 121 which, as already described, engage said second rectilinear longitudinal guide member 31.

Further, said sliding unit 7 comprises a first roll 71 and a second roll 72 pivotally connected to an arm 73, which in turn is pivotally connected to the free end of the rigid arm 70 coaxially with said first roll 71. Said first roll 71 is disposed near the rear wall 411 of said third guide member 41, at the inner side thereof, and said second roll 72, to the contrary, is disposed near the same rear wall at the outer side thereof.

For the reasons set forth below, the arm 73 is maintained at a rear position, aligned with the axis of the rigid arm 70, by a suitable elastic element such as a metallic spring or the like, which for simplicity is not shown in the figures.

Longitudinal guide elements are connected to the upper and lower sides of the doors 11, which elements are marked with the sole reference 5 in the figures since, as stated above, the figures show a scheme generic to both the lower and upper part of the guiding device.

Such longitudinal guide elements 5 are provided with a rectilinear portion 50, extending nearly to the sides of the respective doors, terminate at two inclined portions 51 which are connected to the rectilinear portion 50, and are also provided with two short rectilinear projections 52 extending parallel to rectilinear portions 50. The rectilinear portions 51 are spaced from said rectilinear portions 50 by a distance that is a little greater than the thickness of the doors 11, 12.

Sliding elements 9 are fitted respectively onto the inner (rear) side of the doors 12 at the sides of the upper and lower ends of each door 12. The sliding elements 9 are formed, for instance, as indicated in the figures, by suitable rolls which, when the doors 11 and 12 are disposed in the closed positions thereof, are aligned in a coplanar relation to one another and respectively engage joining portions defined between said projections 52 and the inclined portions 51 extending therefrom.

The above-described device operates as follows.

Firstly, it is pointed out that it is possible to act indifferently on any door 11, 12 of the group of doors.

FIG. 2 clearly illustrates the opening operation of a door 12 of the second group of doors, and reference is hereinafter made to this figure in order to describe in detail such operation.

Initially, the door 12 is aligned, as illustrated in FIG. 1, in a coplanar relation with the other doors and in such a position that the rolls 71, 72 of said sliding unit 7 situated at the end of the rigid arm 70 are positioned at the vertex of the arcuate portion 8.

The door 12 can be opened by pulling it outwardly while pushing it contemporaneously laterally.

As illustrated in FIG. 2, the door 12 is pushed rightwards.

Such actuation makes it possible for the first roll 71 of said sliding unit 7 to be shifted towards the right rectilinear portion 81 of said arcuate portion 8 and to slide afterwards therealong until the first roll 71 is positioned at the beginning of the correspondent rectilinear portion 411 of the guide member 41.

At the same time, the roll 9 situated at the right side of the door 12 slidably engages a joining portion at the left inclined portion 51 of the guide member 5 fitted to the correspondent right side door 11, which has the same shape of that portion of said arcuate portion 8 on which said first roll 71 is sliding. The roll 9 is slid until it is positioned at the beginning of the rectilinear portion 50 of said guide member 5.

If only said first roll 71 positioned on the inner side of said arcuate portion 8 were provided, it could freely slide in each front and rear direction since it would not be guided by a front wall parallel to the rear wall forming the arcuate portion 8.

Thus, in the arrangement described above, said second roll 72 is provided so that the part of the rear wall 411 of the third guide member 41, which forms the arcuate portion 8, is always interposed between the same roll 72 and said first roll 71, whereby the latter is forced to follow exactly the path defined by said wall.

It is pointed out that during the sliding movement of the sliding unit 7 along the arcuate portion 8, the arm 73 is automatically positioned perpendicularly to the wall forming the arcuate portion 8 and can freely rotate coaxially to said first roll 71.

In addition, the action of the spring (not shown in the various figures) which, as already stated, tends to maintain said arm 73 in alignment with the axis of the rigid arm 70, ensures adherence of both rolls 71, 72 onto the wall forming said arcuate portion 8. Such adherence, besides ensuring a precise translation of the sliding unit 7, establishes, particularly during the final closing step of the door, an appropriate braking action by means of a dampening action which is fully effective though soft.

Moreover, the movement of the door 12 is guided not only by the right half of said arcuate portion 8 and the inclined portion 51 of the left end of the guide element 5 fitted to the door 11 adjacent thereto, but also by the articulate parallelogram linkage 6 which maintains the door 12 in a plane parallel to the plane in which the other doors 11, 12 lie.

At the end of the above movement, the door 12 is thus disposed outwardly parallel to and is rather separated from the other doors.

In fact, the right roll 9 thereof is separated (as can be seen from FIG. 2) from the surface of the rectilinear portion 50 of the guide element 5 of the door 11 adjacent thereto. And, at this point, by pushing the door 12 rightwardly again the door can freely continue to translate laterally, while being slidably supported by the arms 61 of the parallelogram linkage 6 and guided by the sliding elements 121 disposed in the guide member 31, until the door is completely situated above the side door 11. Thus, a complete opening and therefore accessibility of the furniture compartment can be attained, which compartment was previously closed by the same door 12.

In addition, it is pointed out that at the end of the starting displacement, the door 12 can be maintained in position and under such conditions that either of the side doors 11 (both the right and left door) can freely slide, if pushed in an adequate manner, towards such door 12 and be arranged at the inner side thereof, so as to provide access to the respective compartments of the furniture which were closed by the same doors.

Moreover, one door 11 of said first group of doors can be directly opened simply by pushing such a door laterally against an adjacent door 12 of the second group of doors, as clearly illustrated by FIG. 3 to which reference is made hereinafter.

In this case, the door 11 is pushed rightwards so that it is shifted by the sliding of the sliding elements 112 thereof relative to the respective longitudinal guide member 21.

As soon as the translation thereof has commenced, the surface of the right inclined portion 51 of the guide element 5 of the door 11 bears against the left sliding element (roll) 9 of the door 12 adjacent thereto, so that the latter in turn tends to be shifted rightwards. And, in this way, the other right slide element (roll) 9 bears against the surface of the left inclined portion 51 of the guide element 5 of the next door 11 and at the same time the rigid arm 70 is also shifted.

Thus, as is evident from FIGS. 1–3, the door 12 acts practically as a wedge interposed between two inclined planes in which the two inclined portions 51 of the two side doors 11 lie.

With respect to similar systems which use a single inclined plane (or other element), such permits a considerable global angle of actuation under the combination of two limited angles of actuation. Thus it is possible to control the outward movement of the door 12 with a very limited side thrust against the door 11 whereby the global actuation is very easy and useful.

In addition, the initial displacements of the doors 12 take place along a trajectory forming a reduced angle with respect to a line orthogonal to the plane of the doors 11, 12. Thus, there is no need to provide the sides of the same doors with wide bevels, which bevels are nonfunctional and are also considerably unaesthetic.

It is to be noted that the sole doors 12, i.e. the doors which besides translating laterally are moved outwardly, require, as seen in FIGS. 1–5, that their sides be beveled convergently inwardly, each of the bevels inclined at an angle practically equal to the angle of said inclined portions 51.

Moreover, the sides of the doors 11 and the doors 12 in practice may be very close (in theory they could be adjacent each other).

By continuing the translation of the door 11 rightwards, the two sliding elements (rolls) 9 of the door 12 adjacent thereto slide onto the respective inclined portions 51 of the guide members 5 fitted to the same door 11 and to the following door 11, and consequently the door 12 is pushed outwardly while sliding contemporaneously rightwards, since it is constrained to proceed along the trajectory defined by the inclined portion 51 of the following door 11, which remains still.

As in the previous case, the movement of the door 12 is also guided by the articulated parallelogram linkage 6 which maintains the door 12 parallel to the other doors 11, 12, as well as by the sliding unit 7 which is sliding along the right side of the arcuate portion 8.

The outward movement of the door 12 is stopped when the left sliding element (roll) 9 thereof arrives at the front of the right inclined portion 51 of the guide member 5 fitted to the door 11, since at this position the sliding element 9 can slide along the rectilinear portion 50 of guide member 5 without being additionally pushed frontwards.

It is to be noted that at this position the sliding unit 7 is disposed with its roll 71 again positioned against the right side of the arcuate portion 8, near the location at which the latter is joined to the rectilinear longitudinal portion of the guide member 41. So, because the rigid arm 70 thereof is prevented from continuing to translate sidewards, the respective door 12 to which it is connected is stopped and cannot be entrained by the door 11 being slid open, which latter door therefore will be disposed behind the door 12.

Furthermore, always at this position, as is clearly evident from FIGS. 2 and 3, the door 12 is located in front of the other doors 11, 12 at a smaller distance than that in the previous case. In practice, such a distance is just enough to allow the door 11 and the other (right side) door 11 to slide behind door 12. Thus, right side door 11 can be actuated to assume an opened position by being freely slid leftwards behind said door 12, instead of the left side door 11 which initially actuated door 12 to its opened position.

The rigid elements 111 which connect the doors 11 to the first longitudinal guide member 21 are disposed in a sliding plane different than that of the arms 61 of the articulated parallelogram linkages 6 which connect the doors 12 to the second longitudinal guide member 31 and of the correspondent rigid arm 70 which connects such doors to the third guide member 41.

More specifically, the rigid elements 111 are located inside of the arms 61, so as to prevent contact between rigid elements 111 and the arms 61 during the reciprocal side translation of the doors.

Now that the device and the operation thereof have been schematically described above, a detailed embodiment thereof will now be described with reference to FIGS. 4–7.

As stated above, the various elements illustrated in the figures of the detailed embodiment which correspond to those elements indicated schematically in FIGS. 1, 2 and 3, are marked with the same numerical references except that literal references "i" and "s" follow the numerical references to indicate whether the elements are disposed on the lower part or upper part of the furniture. It is also pointed out that for reasons of clarity, while FIGS. 4 and 5 illustrate the device as schematically shown in FIG. 1 in which the doors 11 and 12 are positioned in a coplanar alignment with each other in their closed position, FIGS. 6 and 7 illustrate the device in the position schematically shown in FIG. 2 in which the door 12 is displaced outwardly.

Figure 4:
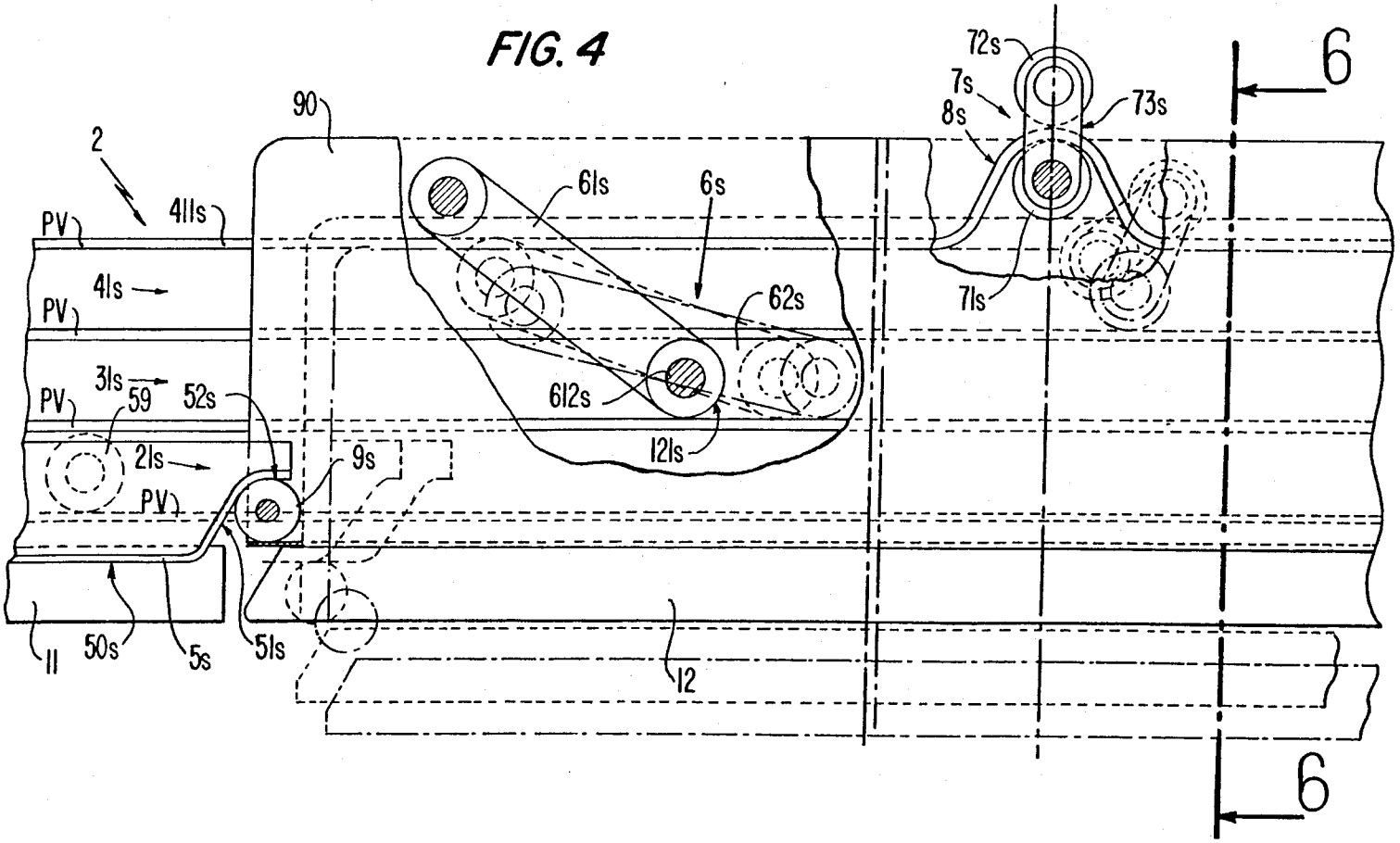
FIG. 4 is an elevational view of the upper part of an embodiment of the device of FIGS. 1, 2 and 3.
Figure 5:
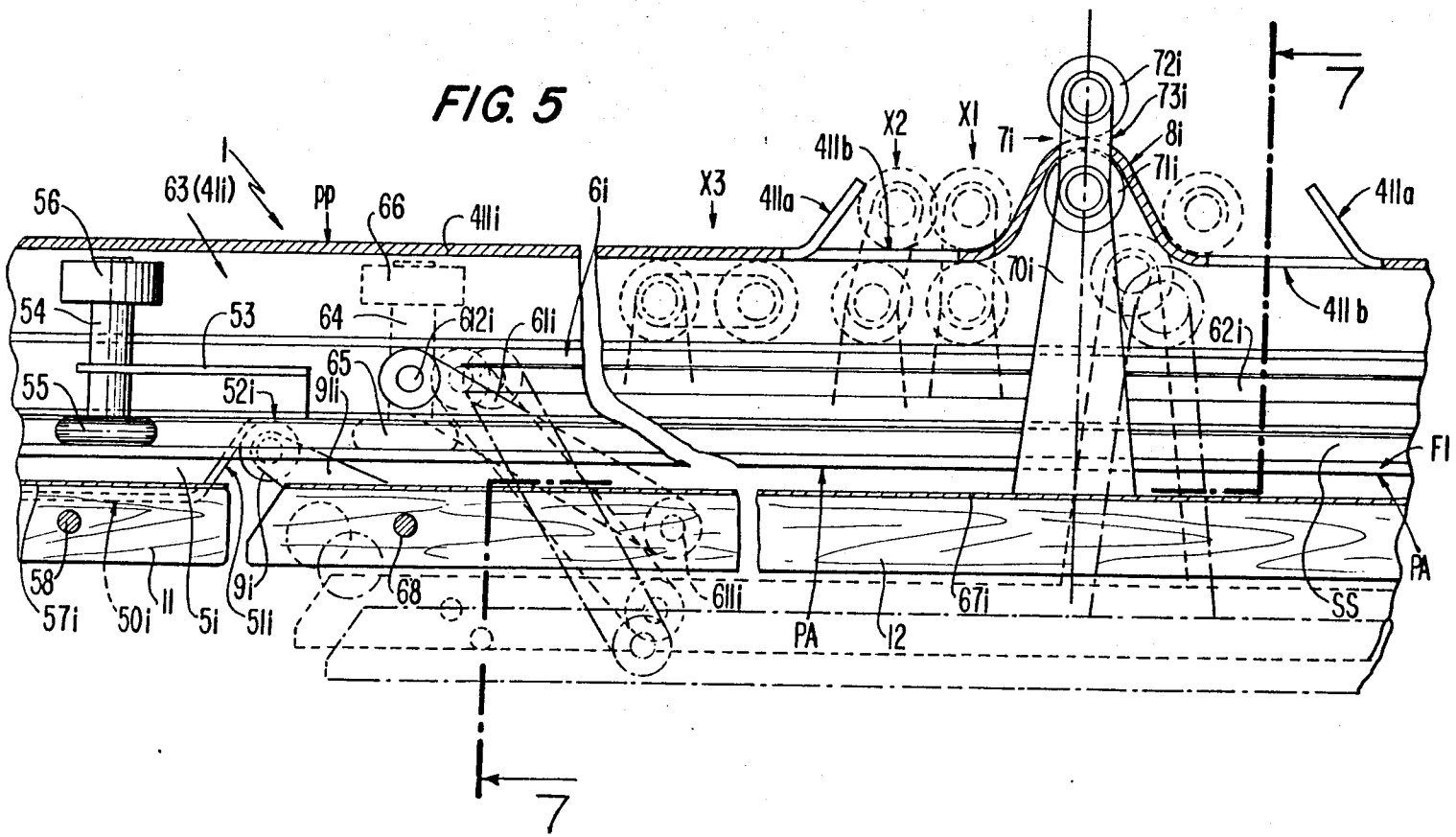
FIG. 5 is a sectional view taken along line 5—5 of FIG. 7 of the lower part of the embodiment of the same device.

Moreover, in FIGS. 4 and 5 there are indicated with a dashed line and a broken line the positions of the doors 12 and the relative elements of the device which correspond, respectively, to those illustrated in FIGS. 3 and 2. Therefore, in FIGS. 6 and 7, it is firstly noted that the longitudinal guide members 21, 31, and 41 are shown as a section 1 thereof at the lower side and as a section 2 thereof at the upper side of the furniture.

As may be particularly seen from FIG. 7, the section 1 is a tubular element having a rectangular cross section, in whose front wall PA is a central longitudinal slit Fl, and a grooved element G3 having a rectangular cross section provided below said slit F1 at the inner part of a rear wall PP thereof. Grooved element G3 is open at its upper side and practically forms the third guide member 41*i*.

Further, two grooved longitudinal elements SI and SS, each defining semicylindrical grooves, are provided at the inner part of said front wall PA, along the upper edge of said slit Fl and at the lower wall PI thereof, respectively.

Thus, as may be particularly seen from FIG. 7 and hereinafter described in more detail, the two other guide members 21*i* and 31*i* are constituted, respectively, by the upper side and the lower side of the section 1.

As is clear from FIG. 6, the section 2 is simply formed by a base plate PB from which four vertical walls PV extend vertically upwardly, which walls define three grooves constituting the three longitudinal guide members 21*s*, 31*s* and 41*s*.

Referring now to FIGS. 4 and 5, it is noted that with respect to the vertical axis of the doors 12, arcuate portions 8*i* and 8*s* protrude rearwardly from the rear walls 411*i* and 411*s* of the longitudinal guide members 41*i* and 41*s* . Arcuate portions 8*i* and 8*s* can be separate elements adequately fitted to the guide members 41*i* and 41*s*.

Also, it is noted that the arcuate portion 8*s* of the upper guide member 41*s* forms a continuous part together with the rear wall 411*s* associated therewith. The arcuate portion 8*i* of the lower guide member 41*i* terminates, for the reasons set forth below, at joining zones where the rear wall 411*i* forms short portions 411*b* and also forms, at the ends thereof, two folded parts 411*a* which are inclined convergently outwardly.

As particularly seen in FIGS. 6 and 7, the sections 1 and 2 are fitted respectively to the front lower part and front upper part of the piece of furniture; and more precisely, the section 1 is arranged between the bottom shelf R and the base board Z thereof while the section 2 is fitted to the upper part of a cover C. Sections 1, 2 are both disposed with their front parts coplanar to the front surface of the piece of furniture. Still referring to FIGS. 4, 5, 6 and 7, the doors 11 and 12, as will be described later, are connected to the sections 1 and 2 to form the elements shown schematically in FIGS. 1, 2 and 3.

The doors 11 are respectively provided, at their lower and upper ends, with two plates so shaped as to form two respective longitudinal guide members 5*i* and 5*s*, forming rectilinear portions 50*i* and 50*s* extending along the front part thereof, inclined portions 51*i* and 51*s* joined to the rectilinear portions, and pairs of short projections 52*i* and 52*s* spaced apart a little more than the thickness of the doors 11 from the rectilinear front portions 50*i* and 50*s*, respectively.

The plates forming said lower longitudinal guide members 5*i* terminate at their rear side with an upwardly orthogonally bent wing 53, to which there are connected the studs 54. The studs pass orthogonally therethrough and are provided at their ends with rolls 55 and 56, thus forming two trucks which correspond to the sliding elements 112 of the schematic diagrams of FIGS. 1–3.

The front roll 55 has a semicylindrical circumferential shape so as to be able to slidingly engage the complementary semicylindrical groove defined by the grooved longitudinal element SS. On the other hand, the rear roll 56 has a cylindrical shape so as to be able to slidingly engage the inner surface of the upper wall PS of the section 1, as will be described later.

As shown in FIG. 7, the trucks formed by the rolls 55, 56 are disposed at the inner side of the section 1. The plates forming the lower longitudinal guide members 5*i* pass through the longitudinal slit F1 and project outside the same section 1 to a portion thereof at the end of which angle brackets 57*i* are connected. From the ends of angle brackets 57*i* extend two short pins 58 with rounds heads.

The plates forming the upper longitudinal guide members 5*s* each have a profile that is a mirror image with respect to that of each of the lower guide members 5*i* but terminate at the rear thereof without any bent wing. The guide members 5*s* are connected to angle brackets 57*s*, whose vertical and downwardly extending wing in turn is connected to the rear part of a respective door 11.

In addition, two downwardly facing rolls 59 engaging the longitudinal guide member 21*s* are rotatably supported at the lower part and near the ends of the upper longitudinal guide members 5*s*. Also, the rolls 59 constitute the sliding elements 112 shown in the schematic diagrams of FIGS. 1–3 at the upper side thereof.

The door 11 is provided with blind bores 19 at the lower side thereof, in correspondence with said pins 58, into which holes such pins 58 extend so as to form a particular removable connection which, as described later, facilitates particular functional advantages.

From what has been described it is evident that the plate forming said guide member 5*i* as well as the element connecting the plate to the trucks formed by the rolls 55, 56, substantially provides a cantilever supported at one end thereof by the trucks and loaded at the other (external) end thereof by the concentrated load generated by the weight of the door 11.

It follows that a moment is generated which causes the roll 55 to be pushed downward against the grooved element SS and the roll 56 to be pushed upward against the inner surface of the upper wall of the section 1. Therefore, the door 11 rests only with its lower end on the front end of the above-mentioned plate and is guided only at its upper end by the rolls 59 which are sliding in the cavity of the first upper guide member 21*s*, so that the connection obtained in the above-described manner by means of the insertion of the pins 58 into the holes 19 of the door 11, which practically provides a hinge, doesn't allow the moment to be exerted on the panel constituting the door 11.

Thus, the door 11 will remain perfectly planar and a device for providing a realignment thereof is not required. The doors 12 are supported at the lower ends thereof in the same manner as the doors 11 by an angle bracket 67 provided with pins 68 extending into the holes 69 of the doors 12. Such elements are identical to the corresponding brackets 57*i*, pins 58, and holes 19 of the doors 11.

The doors 12 are connected at the upper ends thereof to a vertical flange 91 provided on the front part of a plate 90. Plate 90 extends horizontally over the section 2 comprising the upper group of guide members 21*s*, 31*s*, 41*s* and is connected to the guide members 31*s* and 41*s*, as described hereinafter.

Two vertical studs 611*i* are connected to the lower part of the horizontal flange of the angle bracket 67. The studs 611*i* engage the front end portions of two arms 61*i* whose rear end portions, on the contrary, are pivotally supported on vertical studs 612*i*. The studs 612*i* are provided at the ends of a longitudinal bar 62*i*. The above structure forms the lower articulate parallelogram linkage 6*i*.

Moreover, each of the vertical studs 612*i* is crossed orthogonally, near its lower end, by a further horizontal stud 64, at the ends of which stud 64 are connected a front roll 65 and a rear roll 66. Such structure, as is clear from FIG. 7, is substantially identical to the stud 54 and the rolls 55 and 56 thereof and form a truck which slides on the lower part of the section 1 which forms the longitudinal guide member 21*i*.

The arms 61*i* form the elements supporting the door and also, such elements substantially form cantilevers which are supported on said vertical studs 612.

The concentrated load generated by the weight of the door 12 and exerted at the front end of said arms 61*i* produces a moment which causes the front roll 65 to be pushed downward in the groove of the grooved element SI and the rear roll 66 to be pushed upward against the lower surface of the grooved element G3.

The connection of the upper part of the door 12 to the upper guide members is provided as described below.

On the lower part of the plate 90 are pivotally supported two arms 61*s* at one end thereof. The arms 61*s*are pivotally supported on the studs 612*s*, at the other end thereof, through the ends of a longitudinal bar 62*s*, and coaxially to two rolls 121*s* engaging the rectilinear longitudinal guide member 31*s*. The above structure thus forms the upper articulate parallelogram linkage 6s.

In addition, at the lower part of said plate 90 is an arm 73*s* pivotally supported thereon at a central part of its rear end. The arm 73*s* is coaxial to a first roll 71*s* engaging the respective guide member 41*s*, and has a free end at which a second roll 72*s* is pivotally supported. The above structure forms the upper sliding unit 7*s* which engages, as already described, the rear wall 411*s* of the upper guide member 41*s* provided with arcuate portions 8*s* whose functions have been already described.

The plate 90 functions as the rigid arm 70.

At the lower part of the guide structure a rigid arm 70*i* projects toward the rear side of the angle bracket 67. At the free end of the rigid arm 70*i* is rotatably supported both a first roll 71*i* which engages the respective guide member 41*i* , and an arm 73*i*. At the free end of arm 73*i* is rotatably supported a second roll 72*i* .

Thus, the lower sliding unit 7*i* is provided, which unit engages the rear wall 411*i* of the lower guide member 41*i* provided with arcuate portions 8*i* having the already described functions.

It is pointed out that, at the lower part of the guide structure, the elements connecting the door 12 to the respective guide members 21*i*, 31*i* and 41*i* pass through the longitudinal slit F1 provided at the front wall PA of the section P1 and are arranged reciprocally so that they cannot collide when the doors 11 and 12 are translated.

Besides, as already stated and as seen in FIG. 5, at the ends of said arcuate portion 8*i*, the rear wall 411*i* of said guide member 41*i* is broken off at two short portions 411*b*. At the ends of the short portions 411*b* two outwardly convergent inclined lips 411*a* are provided. And, at the rear wall PP of the section 1, a slit F2 extends above the arcuate portion to the ends of said portions 411*b* so as to permit the arm 73*i* to pass therethrough. Such an arrangement is necessary in order not to form a continuous longitudinal slit which would divide said section 1 in two.

The function of such an arrangement is described hereinafter.

At the starting position in which the door 12 is closed and therefore aligned in a coplanar relation with the other doors (see FIG. 5), the rigid arm 70 is positioned coaxial to the arcuate portion 8*i*. And, the arm 73*i* is also aligned coaxial thereto as well as being urged toward the rear side thereof due to the action of a spring (not shown), fitted between the same and said rigid arm 70.

Thus, the first roll 71*i* is positioned on the inner side of the vertex part of said arcuate portion 8*i* and the second roll 72*i* is positioned on the outer side thereof.

When the door 12 is shifted leftwards, the rolls 71*i* and 72*i* are slid along the left part of the arcuate portion 8*i* and arrive at the end thereof, from which the broken portion 411*b* extends (position X1).

By continuing the displacement of the door 12, the second roll 72*i* abuts firstly against the left lip 411*a* (position X2), so that the arm 73*i* begins to rotate about its pivot point. By further continuing this displacement, the rolls 71*i* and 72*i* are both moved into the rectilinear part of the guide member 41*s* (position X3), aligned with the same guide member and positioned orthogonal to the rigid arm 70*i*. The opposite movement of the door causes, at first, the second roll 72*i* to leave the broken portion 411*b*, which roll is biased by said spring and is slid along the lip 411*a*, thus permitting the arm 73*i* to rotate in an opposite direction. Thereafter, the rolls 71*i* and 72*i* re-arrange themselves, respectively, at the inner and outer side of the wall forming said arcuate portion 8*i* while sliding therealong (position X1).

The three positions X1, X2 and X3 of the rigid arm 70*i* and the rolls 71*i*, 72*i* are clearly illustrated in FIG. 5.

Obviously, when the door 12 is shifted rightwards, a symmetrical identical operation occurs.

The device according to the present invention is also provided with two rolls 9*i* rotatably supported on ears 91*i* extending from the inner side of the ends of the angle irons 67, and two rolls 9*s* rotatably supported at a corresponding position on said plate 90.

Such rolls 9*i* and 9*s* are so fitted as to be positioned on the part at which the inclined portions 51*i* and 51*s* is connected to the respective rectilinear projections 52*i* and 52*s* of the longitudinal guide elements 5*i* and 5*s* of the doors 11, when the doors 11 and 12 are disposed in their closed positions.

From what has been described, it is clear that the device according to the present invention presents particular advantages.

In fact, by utilizing such a device the doors may be translated in opposite directions, which translation is usually impossible in the known devices.

In addition, the doors 11 instead of being formed by a single panel can also be of the "bellows" kind, each comprising two vertical panels hinged together and supported at their sides by adequate elements (trucks), which are in sliding engagement with the longitudinal guide members 21*i*, 21*s*. And, it is also possible to use sliding doors which are not coplanar when closed.

The device according to the present invention is more rational, is simpler and is cheaper compared to the known devices used for the same purposes thereof. Moreover, the device according to the present invention avoids the considerable drawbacks which are present in the prior art; in fact, its operation besides being simple requires very limited force to open and close the doors.

Finally, at the end of the closing of the doors, which besides being laterally translated are shifted outwards, the same doors return in position in a very soft and automatically dampened manner, so that no other particular braking devices are needed.

It is well understood that different modifications may be incorporated into the device described without departing from what is claimed. Therefore, the present invention is seen to include all such modifications falling within the scope of the appended claims as being within the true spirit and scope of the invention.

I claim:

1. Guide structure in a piece of furniture comprising:

a group of sliding doors including first and second doors alternately disposed as taken in a lateral direction and coplanar when in respective closed position thereof, each of said first and second doors having upper and lower ends;

a first and a second group of guide members extending longitudinally in said lateral direction and disposed at a front portion of the piece of furniture at lower and upper parts of the piece of furniture, said first group of guide members supporting said first and second doors at the lower ends thereof, and said second group of guide members supporting said first and second doors at the upper ends thereof;

respective rigid connecting elements connecting to each said first door, and sliding elements respectively supported on said rigid connecting elements and in sliding engagement with said first group of guide members, each said first door being slidably guided in said lateral direction by said first group of guide members via said rigid connecting elements and said sliding elements;

respective articulate parallelogram linkages connected to each said second door, and sliding elements supported on said parallelogram linkages at joints thereof and in sliding engagement with said second group of guide members, each said second door being both slidably guided in said lateral direction by said second group of guide members and being forwardly shiftable, from the closed position thereof by an amount sufficient to allow a said first door adjacent thereto to be slid therebehind in the piece of furniture, via said articulate parallelogram linkages and the sliding elements supported thereon;

longitudinal guide elements connected to the upper and lower ends of each of one of said first and second doors, each of said longitudinal guide elements terminating at inclined portions which are inclined in a horizontal plane with respect to said lateral direction; and sliding elements connected to the upper and lower ends of each of the other of said first and second doors adjacent said each of one of said first and second doors, and cooperating with said longitudinal guide elements by abutting said inclined portions when the doors connected thereto are slide laterally to forwardly shift each said second door forwardly from the closed position thereof;

a third group of guide members adjacent and extending parallel to said first and said second groups of guide members, each of the guide members of said third group having a rectilinear portion and an arcuate portion projecting rearwardly from the rectilinear portion in the piece of furniture, each said arcuate portion associated with a respective said second door;

respective rigid elements connected to each said second door, and a respective sliding unit supported on each of said rigid elements connected to each said second door and in sliding engagement with said third group of longitudinal guide members, each said second door being positioned in the closed position thereof under the engagement of each said sliding unit, respectively, with said third longitudinal guide members at the vertex of a said arcuate portion thereof, said arcuate portion establishing the degree to which the second door associated therewith is shiftable forwardly in the piece of furniture.

2. Guide structure as claimed in claim 1, wherein each of said articulate parallelogram linkages comprises a pair of arms of equal length, a rigid element extending from one of the upper and lower ends of a respective said second door, a first set of studs pivotally connecting said paris of arms at respective one ends thereof to said rigid element extending from one of the upper and lower ends of the respective said second door, a longitudinal bar, and a second set of studs pivotally connecting said pairs of arms at respective other ends thereof to said longitudinal bar, the distance between the studs of said first set being the same as the distance between the studs of the second set.

3. Guide structure as claimed in claim 1, wherein said rigid connecting elements connected to each said first door at the lower end thereof support each said first door in a cantilever manner via said sliding elements in sliding engagement with the guide member of said first group that is disposed at the lower part of the piece of furniture, said articulate parallelogram linkages connected to each said second door at the lower end thereof support each said second door in a cantilever manner via said sliding elements in sliding engagement with the guide member of said second group that is disposed at the lower part of the piece of furniture, and further comprising respective joints connected between each said first door and the rigid connecting element connected thereto at the lower end thereof, and between each said second door and the articulate parallelogram linkage connected thereto at the lower end thereof, said respective joints inhibiting moments generated by the weight of the doors at the cantilever supports thereof.

4. Guide structure as claimed in claim 1, wherein each said arcuate portion is a separate member joined to each said rectilinear portion.

5. Guide structure as claimed in claim 1, 'wherein each said sliding unit comprises an arm pivotally connected to the respective rigid element on which said sliding unit is supported, spring means connected to said arm for biasing said arm to a position at which said arm is orthogonal to said lateral direction, a first roll rotatably supported on said arm coaxial to the pivotal connection of said arm and the respective rigid element, and a second roll rotatably supported on said arm.

6. Guide structure as claimed in claim 5, wherein each of said articulate parallelogram linkages comprises a pair of ram of equal length, a rigid element extending form one of the upper and lower ends of a respective said second door, a first set of studs pivotally connecting said pairs of arm at respective one ends thereof to said rigid element extending from one of the upper and lower ends of the respective said second door, a longitudinal bar, and a second set of studs pivotally connecting said pairs of arms at respective other ends thereof to said longitudinal bar, the distance between the studs of said first set being the same as the distance between the studs of the second set.

7. Guide structure as claimed in claim 1, wherein the group comprising the first, second, and third guide members disposed at said lower part of the piece of furniture is an integral section having a rectangular cross section, a vertically extending front wall defining a slit extending longitudinally therethrough, respective ones of said rigid connecting elements connected to each said first door and said parallelogram linkages connected to each said second door extending through said slit, a rear wall, and an upwardly open angle element extending within said section from a location on said rear wall disposed below said slit and defining with said rear wall one of the third guide members of said third group, said rear wall having a portion thereof projecting rearwardly in the piece of furniture to form a said arcuate portion of said one of the third guide members, respectively, said rear wall also defining two openings therein laterally and on opposite sides of said arcuate portion, said area wall having two inclined lips respectively extending from distal ends of said two openings and converging towards the arcuate portion to which said two openings are laterally defined, and said rear wall also defining a slit extending therethrough above said arcuate portion, a said sliding unit extending through the slit defined by said rear wall.

8. Guide structure as claimed in claim 7, wherein each said arcuate portion is a separate member joined to each said rectilinear portion.

9. Guide structure as claimed in claim 1, wherein the group comprising the first, second and third guide members disposed at said upper part of the piece of furniture is an integral section having a base plate, and four spaced apart walls extending orthogonally to said base plate so as to define three grooves therebetween each forming a respective one of the first, second and third guide members disposed at said upper part of the pieces of furniture.

10. Guide structure as claimed in claim 9, wherein each said arcuate portion is a separate member joined to each said rectilinear portion.

11. Guide structure as claimed in claim 1, wherein each group comprising said first, second and third guide members is an integral extrusion.

12. Guide structure as claimed in claim 11, wherein the extrusion disposed at said lower part of the piece of furniture has a rectangular cross section, a vertically extending front wall defining a slit extending longitudinally therethrough, respective ones of said rigid connecting elements connected to each said first door and said parallelogram linkages connected to each said second door extending through said slit, a rear wall, and an upwardly open angle element extending within said second from a location on said rear wall disposed below said list and defining with said rear wall one of the third guide members of said third group, said rear wall having a portion thereof projecting rearwardly in the piece of furniture to form a said arcuate portion of said one of the third guide members, respectively, said rear wall also defining two openings therein laterally and on opposite sides of said arcuate portion, said rear wall having two inclined lips respectively extending from distal ends of said two openings and converging towards the arcuate portion to which said two openings are laterally defined, and said rear wall also defining a list extending therethrough above said arcuate portion, a said sliding unit extending through the slit defined by said rear wall.

13. Guide structure as claimed in claim 12, wherein each said arcuate portion is a separate member joined to each said rectilinear portion.

14. Guide structure as claimed in claim 11, wherein the extrusion disposed at said upper part of the piece of furniture has a base plate, and four spaced apart walls extending orthogonally to said base plate so as to define three grooves therebetween each forming a respective one of the first, second and third guide members disposed at said upper part of the piece of furniture.

15. Guide structure as claimed in claim 14, wherein each said arcuate portion is a separate member joined to each said rectilinear portion.

16. Guide structure as claimed in claim 11, wherein each said arcuate portion is a separate member joined to each said rectilinear portion.

* * * * *